US005858950A

United States Patent [19]

Surutzidis et al.

[11] Patent Number: 5,858,950

[45] Date of Patent: Jan. 12, 1999

[54] LOW SUDSING LIQUID DETERGENT COMPOSITIONS

[75] Inventors: Athanasios Surutzidis, Wemmel; Andrew Albon Fisk, Strombeek-Bever; Jean-Pol Boutique, Genbloux; Roger Jeffery Jones, Jauche, all of Belgium

[73] Assignee: The Procter & Gamble Company, Cincinnati, Ohio

[21] Appl. No.: 569,067

[22] PCT Filed: Jun. 22, 1994

[86] PCT No.: PCT/US94/07200

§ 371 Date: Apr. 4, 1996

§ 102(e) Date: Apr. 4, 1996

[87] PCT Pub. No.: WO95/00117

PCT Pub. Date: Jan. 5, 1995

[30] Foreign Application Priority Data

Jun. 28, 1993 [EP] European Pat. Off. ..... 93870123

[51] Int. Cl.[6] ..... C11D 1/12

[52] U.S. Cl. ..... 510/350; 510/352; 510/357; 510/495; 510/498

[58] Field of Search ..... 510/350, 352, 510/357, 495, 498

[56] References Cited

U.S. PATENT DOCUMENTS

| | | | |
|---|---|---|---|
| 3,625,906 | 12/1971 | Alsbury et al. | 252/121 |
| 4,028,280 | 6/1977 | Murata et al. | 252/526 |
| 4,495,092 | 1/1985 | Schmid et al. | 252/559 |
| 4,931,216 | 6/1990 | Igarashi et al. | 252/547 |
| 5,015,414 | 5/1991 | Kamegai et al. . | |
| 5,183,601 | 2/1993 | Jisai et al. . | |
| 5,320,783 | 6/1994 | Marin et al. . | |
| 5,454,982 | 10/1995 | Murch et al. | 560/323 X |
| 5,478,502 | 12/1995 | Swift | 510/352 X |

FOREIGN PATENT DOCUMENTS

| | | |
|---|---|---|
| 4111335-A1 | 10/1992 | Germany . |
| WO 91/16409 | 10/1991 | WIPO . |

*Primary Examiner*—Michael Lusignan
*Attorney, Agent, or Firm*—Jacobus C. Rasser; Kim W. Zerby; Ken K. Patel

[57] ABSTRACT

Liquid detergent compositions containing a branched anionic surfactant. These compositions are low sudsing and have improved hydrophobic greasy soil removal performance.

8 Claims, No Drawings

LOW SUDSING LIQUID DETERGENT COMPOSITIONS

TECHNICAL FIELD

The present invention relates to low sudsing liquid detergent compositions.

BACKGROUND OF THE INVENTION

Anionic surfactant compositions are well known in the art and are desirable components in liquid detergents due to their good cleaning ability, especially with respect to hydrophobic greasy soil removal. However, the incorporation of anionic surfactants in typical detergent compositions results in high sudsing formulations.

A number of systems have been described in the art for use in detergent compositions in order to counter act the sudsing ability of the surfactants. Such suds suppressing systems include anti-foam agents such as silicone. However, anti-foam agents have problems associated with them such as the difficulty to maintain them as a dispersion in liquid compositions. In addition silicone anti-foam agents are difficult to process and are expensive.

Therefore it is an object of the present invention to provide a liquid detergent composition comprising an anionic surfactant, said composition having a controlled sudsing profile, said composition requiring a minimum amount of conventional suds suppressing agents.

It has now been found that this can be achieved by formulating a liquid detergent composition comprising a conventional anionic surfactant in combination with an -branched anionic surfactant.

It has unexpectedly been found that such surfactant combinations provide controlled sudsing, and simultaneously improve said compositions' performance on hydrophobic greasy soil removal.

Another advantage of the present invention is that the sudsing is reduced by the adaptation of straight chain anionic surfactants to their -branched counterparts, i.e. Guerbet anionic surfactants and thus other suds suppressing agent may only be required in minimum amounts.

Another advantage of the present invention is that the surfactants are easier to formulate due to the increased solubility of the surfactant. Furthermore, said compositions are easier to form as 'concentrated' compositions because of the almost total omission of conventional suds suppressing agents. In addition the compositions are cheaper to formulate.

Another advantage of the compositions of the present invention is that said compositions are phase stable.

The term "Guerbet" surfactant as used herein refers to branched surfactants derived from 2-alkyl-alkanol.

Guerbet surfactants are known in the art. DE 41 11 335 discloses a low sudsing ternary surfactant mixture comprising an alkylglycoside, linear and branched secondary dialkylethersulphates and sulphate and sulphonate anionic surfactants. There is no specific mention of Guerbet anionic surfactants.

WO 91/16409 discloses a liquid detergent composition comprising branched primary alkyl sulphates. There is no mention of suds suppressing properties or any specific mention of Guerbet anionic surfactants.

SUMMARY OF THE INVENTION

The present invention is a liquid detergent composition comprising one or more of an anionic surfactant, characterized in that said anionic surfactant comprises from 1% to 99% by weight of said anionic surfactant of a compound according to the formula:

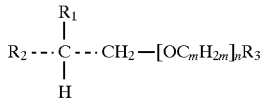

wherein $R_1$ is a $C_3$–$C_{22}$ alkyl group, $R_2$ is a $C_3$–$C_{22}$ alkyl group. m is 2, 3 or 4, n is between 0 and 14 and $R_3$ is a sulphate or a sulphonate.

All weights ratios and percentages are given by the weight of the total composition unless otherwise stated.

DETAILED DESCRIPTION OF THE INVENTION

The detergent compositions according to the present invention comprise an anionic surfactant, characterized in that said anionic surfactant comprises from 1% to 99% by weight of said anionic surfactant of a compound according to the formula:

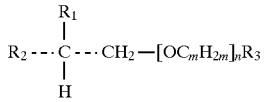

herein after referred to as Guerbet anionic surfactant. Said Guerbet anionic surfactants are low sudsing due to the -branching. The compositions of the present invention require only a minimum amount of other suds suppressing agents. Said amount as used herein being an amount less than that used in conventional liquid detergents comprising anionic surfactants.

According to the present invention $R_1$ is a $C_3$–$C_{22}$, preferably a $C_3$–$C_{10}$, more preferably a $C_3$–$C_8$ alkyl group. Said $R_1$ alkyl group may be linear or branched, saturated or unsaturated. $R_2$ is a $C_3$–$C_{22}$, preferably a $C_6$–$C_{14}$, more preferably a $C_6$–$C_{12}$ alkyl group. Said $R_2$ alkyl group may be linear or branched, saturated or unsaturated. n is between 0 and 14, preferably between 0 and 7, more preferably between 0 and 5. $R_3$ is a sulphate or a sulphonate or mixtures thereof.

The Guerbet anionic surfactant is typically present at levels from 1 to 70%, preferably from 5 to 50%, more preferably from 5 to 25% by weight of the total detergent composition.

According to the present invention the compositions may further comprise non Guerbet anionic surfactants. Suitable anionic surfactants are selected from the group of sulphates and sulphonates. The like anionic surfactants are well known in the detergent art and have found wide application in commercial detergents. Preferred anionic sulphates and sulphonates have in their molecular structure an alkyl radical containing from about 8 to about 22 carbon atoms. Examples of such preferred anionic surfactants are the reaction products obtained by sulphating $C_8$–$C_{18}$ fatty alcohols derived from e.g. tallow oil, palm oil, palm kernel oil and coconut oil; alkyl benzene sulphonates wherein the alkyl group contains from about 9 to about 15 carbon atoms;sodium alkylglyceryl ether sulphonates; ether sulphates of fatty alcohols derived from tallow and coconut oils; coconut fatty acid monoglyceride sulphates and sulphonates; water soluble salts of paraffin sulphonates having from about 8 to about 22 carbon atoms in the alkyl chain. Sulphonated olefin surfactants as more fully described in e.g. U.S. Pat. No.

3,332,880 can also be used. The neutralizing cation for the anionic synthetic sulphonates and/or sulphates is represented by conventional cations which are widely used in detergent technology such as sodium, potassium or alkanolammonium.

A suitable anionic synthetic surfactant component herein is represented by the water soluble salts of an alkylbenzene sulphonic acid, preferably sodium alkylbenzene sulphonates, preferably sodium alkylbenzene sulphonates having from about 10 to 15 carbon atoms in the alkyl group.

Another anionic surfactant suitable for use herein can be alkyl alkoxylated sulphate surfactants. Alkyl alkoxylated sulphate surfactants hereof are water soluble salts or acids of the formula $RO(A)_mSO_3M$ wherein R is an unsubstituted $C_{10}$–$C_{24}$ alkyl or hydroxylalkyl group having a $C_{10}$–$C_{24}$ alkyl component, preferably a $C_{12}$–$C_{18}$ alkyl or hydroxylalkyl, A is an ethoxy or propoxy unit, m is greater than zero, typically between about 0.5 and about 6, more preferably between about 0.5 and 3, and M is H or a cation which can be for example a metal cation (e.g. sodium, potassium, lithium, calcium, magnesium, etc.), ammonium or substituted-ammonium cation. Alkyl ethoxylated sulphates as well as alkyl propoxylated sulphates are contemplated herein. Specific examples of substituted ammonium cations include methyl-, dimethyl, trimethyl-ammonium cations and those derived from alkanolamines, eg. monoethanolamine, diethanolamine and triethanolamine. Exemplary surfactants are $C_{12}$–$C_{18}$ alkyl polyethoxylate (1.0) sulphate ($C_{12}$–$C_{18}$E(1.0)M), $C_{12}$–$C_{18}$ alkyl polyethoxylate (2.25) sulphate ($C_{12}$–$C_{18}$E(2.25)M), $C_{12}$–$C_{18}$ alkyl polyethoxylate (3.0) sulphate ($C_{12}$–$C_{18}$E(3.0)M), $C_{12}$–$C_{18}$ alkyl polyethoxylate (4.0) sulphate ($C_{12}$–$C_{18}$E(4.0)M), wherein M is conveniently selected from sodium and potassium.

Another type of anionic surfactant suitable for use herein are alkyl ester sulphonate, which can be synthesized according to known methods disclosed in the technical literature. For instance, linear esters of $C_8$–$C_{20}$ carboxylic acids can be sulphonated with gaseous $SO_3$ according to "The Journal of the American Oil Chemists Society", 52 (1975), pp. 323–329. Suitable starting materials would include natural fatty substances as derived from tallow, palm and coconut oils. The preferred alkyl ester sulphonate, comprise alkyl ester sulphonates of the structural formula

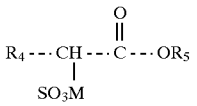

wherein $R_4$ is a $C_8$–$C_{20}$ hydrocarbyl, preferably an alkyl or combination thereof $R_5$ is a $C_1$–$C_6$ hydrocarbyl, preferably an alkyl or combination thereof and M is a soluble salt forming cation. Suitable salts include metal salts such as sodium, potassium and lithium salts and substituted or unsubstituted ammonium salts, such as methyl-, dimethyl-, trimethyl and dimethyl piperdinium and cations derived from alkanolamines, e.g. monoethanolamine, diethanolamine and triethanolamine. Preferably $R_4$ is $C_{10}$–$C_{16}$ alkyl and $R_5$ is methyl, ethyl or isopropyl. Especially preferred are the methyl ester sulphonates wherein $R_4$ is $C_{14}$–$C_{16}$ alkyl.

When included herein, the non-Guerbet anionics are present at levels from 1% to 40%, preferably from 3% to 20%, by weight of the total detergent composition.

The rest of the liquid detergent composition according to the present invention is made of conventional detergency ingredients, i.e. water, surfactants, builders and others.

The liquid detergent compositions herein may additionally comprise as an optional ingredient from 1% to 50%, preferably from 5% to 25% of an organic surface-active agent selected from nonionic, cationic and zwitterionic surface active agents and mixtures thereof.

The nonionic surfactants suitable for use herein include those produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms They can also be formed by the condensation of propylene oxide with a lower molecular weight compound. n usually varies from about 2 to about 24.

A preferred class of nonionic ethoxylates is represented by the condensation product of a fatty alcohol having from 12 to 15 carbon atoms and from about 4 to 10 moles of ethylene oxide per mole or fatty alcohol. Suitable species of this class of ethoxylates include: the condensation product of $C_{12}$–$C_{15}$ oxo-alcohols and 3 to 9 moles of ethylene oxide per mole of alcohol; the condensation product or narrow cut $C_{14}$–$C_{15}$ oxo-alcohols and 3 to 9 moles of ethylene oxide per mole of fatty(oxo)alcohol; the condensation product of a narrow cut $C_{12}$–$C_{13}$ fatty(oxo)alcohol and 6,5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 4 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo alcohols.

The compositions according to the present invention contain from 0% to 30% preferably from 0% to 10% of nonionic surfactants.

Suitable cationic surfactants for use herein include quaternary ammonium compounds of the formula $R_1R_2R_3R_4N^+$ where $R_1$,$R_2$ and $R_3$ are methyl groups, and $R_4$ is a $C_{12}$–$C_{15}$ alkyl group, or where $R_1$ is an ethyl or hydroxy ethyl group. $R_2$ and $R_3$ are methyl groups and $R_4$ is a $C_{12}$–$C_{15}$ alkyl group. The compositions according to the present invention contain from 0% to 20% of cationic surfactants.

Another optional ingredient are zwitterionic surfactants. Suitable zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxvlated ammonium sulphonates and sulfates disclosed in U.S. Pat. Nos. 3,925,262, Laughlin et al., issued Dec. 9, 1975 and 3,929,678, Laughlin et al., issued Dec. 30, 1975. The compositions according to the present invention contain from 0% to 20% of zwitterionic surfactants.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Also suitable as nonionic surfactants are poly hydroxy fatty acid amide surfactants of the formula $$R^2\text{–}C(O)\text{–}N(R^1)\text{–}Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R_CH(COOH) $CH_2$(COOH) wherein R is $C_{10-20}$ alkyl or alkenyl, preferably $C_{12-16}$, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium ammonium and alkanolammonium salts.

Other suitable polycarboxylates are oxodisuccinates and mixtures of tartrate monosuccinic and tartrate disuccinic acid such as described in U.S Pat. No. 4,663,071.

Suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid, fatty acids and succinic acid derivatives described herein above. The builder system according to the present invention preferably represents from 0% to 30%, preferably from 5% to 25% by weight of the total composition.

The compositions according to the invention preferably comprise enzymes. Suitable enzymes for use herein are protease, lipases, cellulases and amylases and mixtures thereof. The compositions according to the present invention may also comprise an enzyme stabilizing system. Any conventional enzyme stabilizing system is suitable for use herein, and preferred enzyme stabilizing systems are based on boric acid or derivatives thereof, 1,2-propanediol, carboxylic acids, and mixtures thereof The compositions according to the present invention contain from 0% to 15%, more preferably from 0% to 5% of enzymes.

The compositions herein can contain a series of further, optional ingredients. Examples of the like additives include solvents, alkanolamines, pH adjusting agents, suds suppressing agents such as silicones and 2-alkyl-alkanol, opacifiers, agents to improve the machine compatibility in relation to enamel-coated surfaces, perfumes, dyes, bactericides, brighteners, soil release agents, softening agents and the like.

The compositions according to the present invention can be formulated as conventional liquid detergent compositions or, as an alternative as so-called "concentrated" liquid detergent compositions, i.e. liquid detergent compositions comprising less than 30% by weight of water.

Whilst the detergent compositions of the invention are of particular utility in machine washing processes, most especially when formulated as heavy duty liquid laundry detergent compositions, they may also be usefully be employed in other washing processes where suds control is of importance. In particular the compositions of the invention may be usefully be formulated as machine dishwashing compositions, especially granular machine dishwashing compositions.

EXAMPLES

The following compositions are made by combining, the following ingredients in the listed proportions.

| Composition in % | A | B | C | D | E |
|---|---|---|---|---|---|
| Branched $C_{12}$–$C_{15}$ alkyl sulphate* | 5 | 10 | 20 | 25 | — |
| Branched $C_{12}$–$C_{15}$ alkyl 3EO sulphate** | — | — | — | — | 25 |
| Linear $C_{12}$–$C_{14}$ alkyl sulphate | 15 | 10 | 1 | 1 | — |
| Fatty alcohol ($C_{12}$–$C_{15}$ ) ethoxylate | 12 | 12 | 12 | 12 | 12 |
| Fatty acid | 10 | 10 | 10 | 10 | 10 |
| Oleic acid | 4 | 4 | 4 | 4 | 4 |
| Citric acid | 1 | 1 | 1 | 1 | 1 |
| Diethylenetriaminepenta-methylene phosphonic acid | 1.5 | 1.5 | 1.5 | 1.5 | 1.5 |
| Monoethanolamine | 3 | 3 | 3 | 3 | 3 |
| Propanediol | 1.5 | 1.5 | 1.5 | 1.5 | 1.5 |
| Ethanol | 10 | 10 | 10 | 10 | 10 |
| Ethoxylated tetraethylene pentamine | 0.7 | 0.7 | 0.7 | 0.7 | 0.7 |
| Thermamyl$^R$ 300 KNU/g | 0.13 | 0.13 | 0.13 | 0.13 | 0.13 |
| Carezyme$^R$ 5000 CEVU/g | 0.014 | 0.014 | 0.014 | 0.014 | 0.014 |
| Protease 40 mg/g | 1.8 | 1.8 | 1.8 | 1.8 | 1.8 |
| Lipolase$^R$ 100 KLU/g | 0.14 | 0.14 | 0.14 | 0.14 | 0.14 |
| Endoglucanase A 5000 CEVU/g | 0.53 | 0.53 | 0.53 | 0.53 | 0.53 |
| Water & Minors (suds suppressors, perfume) | up to 1 00 parts | | | | |
| pH adjusted to 7.5–9 with NaOH | | | | | |

*Lial $C_{12}$–$C_{15}$ alkyl sulphate Na salt prepared from the Lial $C_{12}$–$C_{15}$ alcohol available from Enichem

**Lial $C_{12}$–$C_{15}$ alkyl ethoxy sulphate Na salt prepared from the Lial $C_{12}$–$C_{15}$ alcohol 3 times ethoxylated available from Emichem

What is claimed is:

1. A liquid detergent composition comprising one or more of an anionic surfactant having the formula:

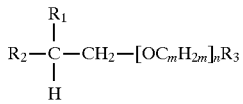

wherein $R_1$ is a $C_3$–$C_{22}$ alkyl group, $R_2$ is a $C_3$–$C_{22}$ alkyl group, m is 2, 3 or 4, n is between about 3 and 14 and $R_3$ is a sulphate or a sulphonate.

2. A liquid detergent composition according to claim 1, wherein $R_1$ is preferably a $C_3$–$C_{10}$ alkyl group and $R_2$ is preferably a $C_6$–$C_{14}$ alkyl group, n is between 0 and 7 and $R_3$ is a sulphate or a sulphonate.

3. A liquid detergent composition according to claim 1, wherein $R_2$ is $C_6$–$C_{12}$ alkyl group, $R_1$ is $C_3$–$C_8$ alkyl group and $R_3$ is a sulphate.

4. A liquid detergent composition according to claim 1, wherein the anionic surfactant is present at a level of from 1 to 70%, by weight of the detergent composition.

5. A liquid detergent composition according to claim 1, further comprising an anionic surfactant selected from alkyl sulphates, alkylbenzene sulphonates, alkyl alkoxylated sulphates and alkyl ester sulphonates.

6. A liquid detergent composition according to claim 1, wherein the anionic surfactant is present at a level of from 5 to 50%, by weight of the detergent composition.

7. A liquid detergent composition according to claim 1, wherein the anionic surfactant is present at a level of from 5 to 25%, by weight of the detergent composition.

8. A liquid detergent composition comprising one or more of an anionic surfactant having the formula:

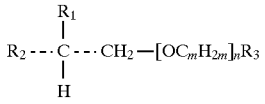

wherein $R_1$ is a $C_3$–$C_{22}$ alkyl group, $R_2$ is a $C_3$–$C_{22}$ alkyl group, m is 2, 3 or 4, n is 0 and $R_3$ is a sulphate.

* * * * *